US009518591B2

(12) United States Patent
Schmitt et al.

(10) Patent No.: US 9,518,591 B2
(45) Date of Patent: Dec. 13, 2016

(54) COMPRESSOR OF AN EXHAUST-GAS TURBOCHARGER

(75) Inventors: Frank Schmitt, Muenchweiler/Alsenz (DE); Tom Heuer, Winnweiler (DE)

(73) Assignee: BorgWarner Inc., Auburn Hills, MI (US)

( * ) Notice: Subject to any disclaimer, the term of this patent is extended or adjusted under 35 U.S.C. 154(b) by 86 days.

(21) Appl. No.: 13/127,807

(22) PCT Filed: Nov. 9, 2009

(86) PCT No.: PCT/US2009/063679

§ 371 (c)(1),
(2), (4) Date: May 5, 2011

(87) PCT Pub. No.: WO2010/059447

PCT Pub. Date: May 27, 2010

(65) Prior Publication Data

US 2011/0214421 A1 Sep. 8, 2011

(30) Foreign Application Priority Data

Nov. 18, 2008 (DE) ..... 10 2008 057 829

(51) Int. Cl.
*F04D 29/42* (2006.01)
*F02B 39/00* (2006.01)
(Continued)

(52) U.S. Cl.
CPC ..... *F04D 29/4213* (2013.01); *F02B 39/00* (2013.01); *F02M 26/09* (2016.02); *F04D 29/685* (2013.01)

(58) Field of Classification Search
CPC .. F02B 39/00; F02M 25/0712; F04D 29/4213; F04D 29/685; Y02T 10/121
(Continued)

(56) References Cited

U.S. PATENT DOCUMENTS 7,014,421 B2 3/2006 French
7,475,539 B2 * 1/2009 Chen ..... 60/597
(Continued)

FOREIGN PATENT DOCUMENTS

JP 2000130276 A 5/2000
KR 10-2004-0021937 A 3/2004
(Continued)

OTHER PUBLICATIONS

English Machine Translation of KR 10-2004-0021937.*

*Primary Examiner* — Nicholas J Weiss
*Assistant Examiner* — Paul Thiede
(74) *Attorney, Agent, or Firm* — A. Michael Tucker; Stephan A. Pendorf; Patent Central LLC

(57) ABSTRACT

A compressor of an exhaust-gas turbocharger has a compressor housing in which a compressor wheel is arranged. The compressor housing has an inlet region. A contour ring is arranged in the compressor housing between the inlet region and the compressor wheel. The contour ring, together with an adjacent wall of the compressor housing, delimits a circulation chamber which has a first connecting opening facing toward the inlet region and a second connecting opening adjacent to the compressor wheel. An exhaust-gas recirculation device has an inlet line which is arranged in the compressor housing and which opens out into the circulation chamber.

2 Claims, 2 Drawing Sheets

(51) Int. Cl.
*F04D 29/68* (2006.01)
*F02B 37/00* (2006.01)

(58) Field of Classification Search
USPC ..... 60/605.1, 605.2
See application file for complete search history.

(56) References Cited

U.S. PATENT DOCUMENTS

2006/0045764 A1* 3/2006 Thompson ..... F01M 13/021
417/313
2007/0266705 A1* 11/2007 Wood et al. ..... 60/599

FOREIGN PATENT DOCUMENTS

KR 1020040034452 A 4/2004
WO 2009077748 A1 6/2009

* cited by examiner

COMPRESSOR OF AN EXHAUST-GAS TURBOCHARGER

FIELD OF THE INVENTION

The invention relates to a compressor of an exhaust-gas turbocharger.

BACKGROUND OF THE INVENTION

A compressor of said type is known from EP 0 545 953 B1. Said compressor is provided with a device for characteristic map stabilization, which device has a circulation chamber which is connected by means of a connecting opening to the main flow in the inlet region, and to the main flow by means of a connecting opening in a contour wall between a rotor inlet and a rotor outlet.

WO 2008/070649 A1 also discloses a compressor which has, in its compressor inlet, an exhaust-gas mixing device with which low-pressure exhaust-gas recirculation is possible.

SUMMARY OF THE INVENTION

It is an object of the present invention to create a compressor by means of which it is possible to combine the advantages of characteristic-map-stabilizing measures with those of low-pressure exhaust-gas recirculation, and in particular to obtain good thorough mixture of the exhaust gas and fresh air, and also to obtain an aerodynamically efficient mixing facility which requires little installation space.

Said object is achieved by means of the features of a compressor of an exhaust-gas turbocharger. The compressor includes a compressor housing in which a compressor wheel is arranged. The compressor housing has an inlet region. A contour ring is arranged in the compressor housing between the inlet region and the compressor wheel. The contour ring and an adjacent wall of the compressor housing delimit a circulation chamber. The circulation chamber has a first connecting opening facing toward the inlet region and a second connecting opening adjacent to the compressor wheel. An exhaust-gas recirculation device has an inlet line that is arranged in the compressor housing. The inlet line opens out into the circulation chamber.

The fact that the inlet line of the exhaust-gas recirculation device opens out into the circulation duct of the device for characteristic map stabilization yields the advantage of a very simple design, a considerable reduction in installation space and a very thorough mixture of the recirculated exhaust gases and the fresh air sucked in by the compressor wheel.

Here, the inlet line may open out into the circulation chamber directly upstream of a first connecting opening, in the region of said connecting opening or downstream of the connecting opening as viewed in the flow direction of the supplied exhaust gases.

A further improvement in the thorough mixture can be obtained primarily by means of swirl generation, and the flow losses can be reduced in particular as a result of the inclination in the direction of the longitudinal axis of the compressor housing.

It is also possible to obtain a minimization of noise as a result of the provision of a ring upstream of the first connecting opening of the circulation chamber, that is to say between the inlet region and the first connecting opening.

BRIEF DESCRIPTION OF THE DRAWINGS

Further details, advantages and features of the present invention emerge from the following description of exemplary embodiments on the basis of the drawing, in which.

DETAILED DESCRIPTION OF THE INVENTION

Figure 1:
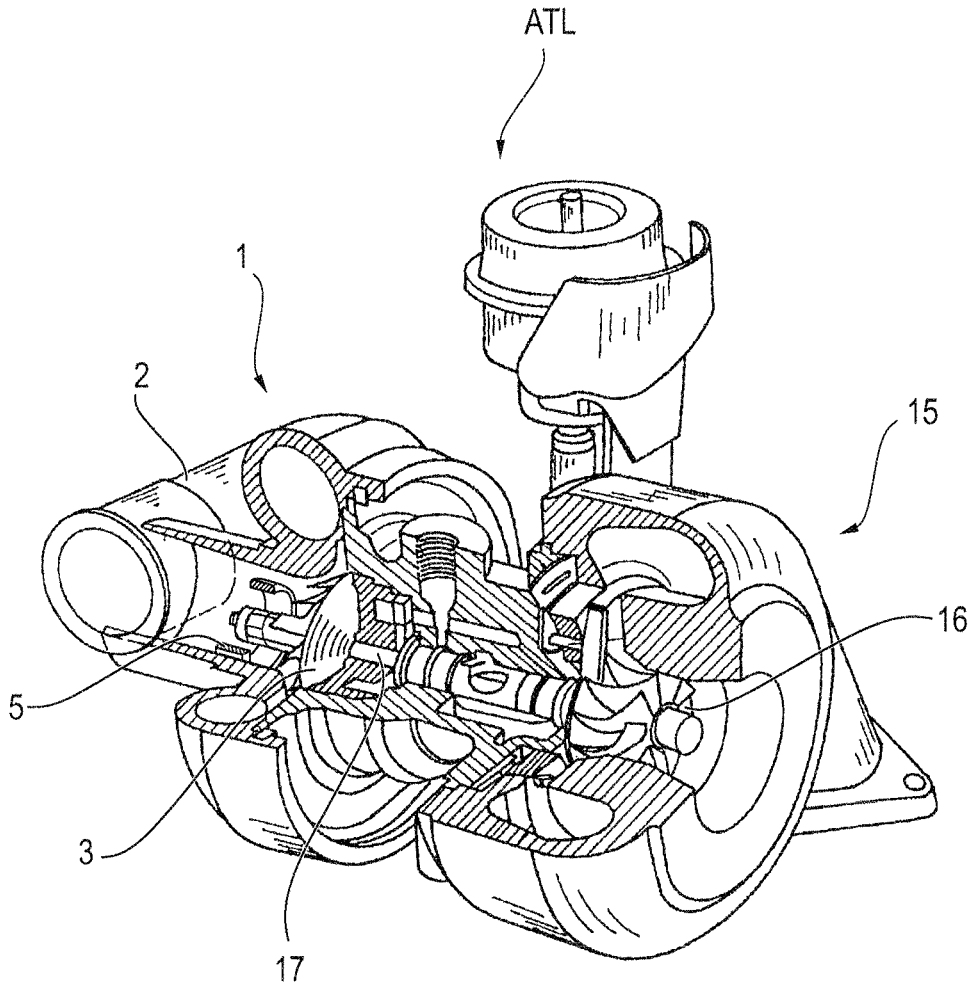
FIG. 1 shows a sectional perspective illustration of an exhaust-gas turbocharger according to the invention in which the compressor according to the invention can be used.
Figure 2:
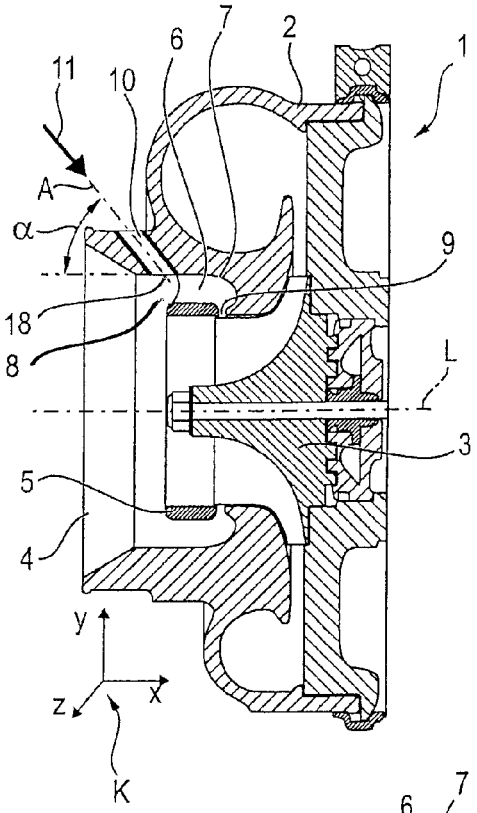
FIG. 2 shows a sectional illustration of the compressor according to the invention.
Figure 3:
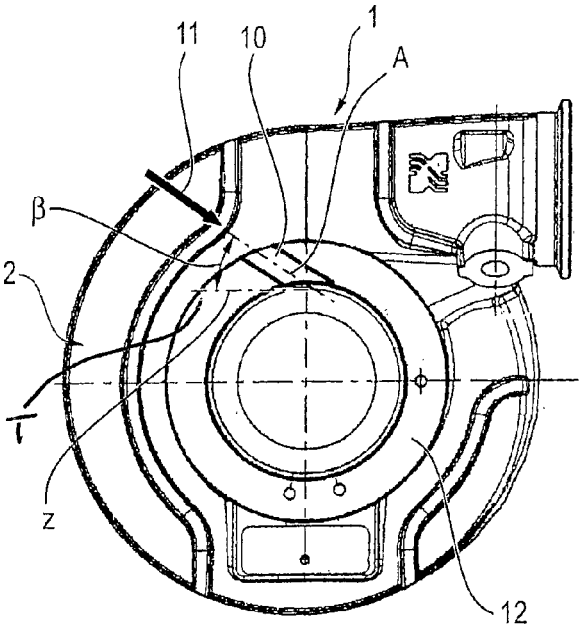
FIG. 3 shows a plan view, rotated through 90°, of the compressor according to FIG. 2.
Figure 4:
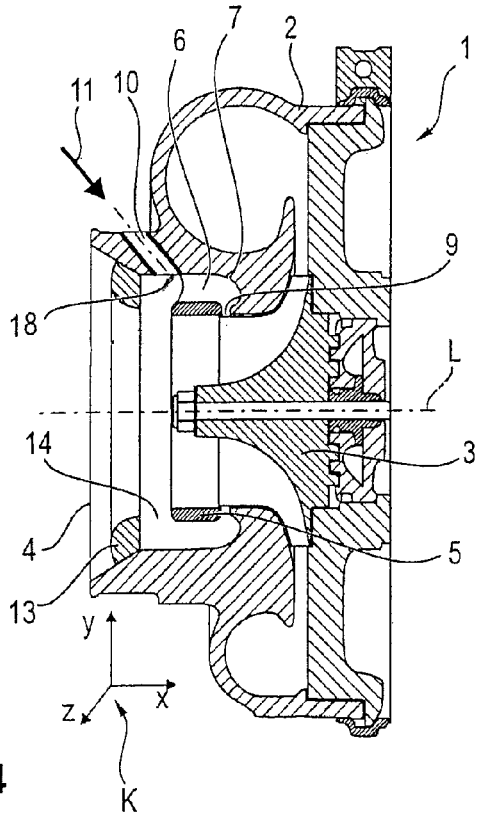
FIG. 4 shows an illustration, corresponding to FIG. 2, of a second embodiment of the compressor according to the invention.

FIG. 1 illustrates an exhaust-gas turbocharger 1 according to the invention in which the compressor described in detail on the basis of the subsequent FIGS. 2 to 4 can be used. Accordingly, FIG. 1 shows only the basic components of exhaust-gas turbochargers of said type, since the details of the compressor according to the invention are not visible in FIG. 1 on account of the selected sectional illustration.

Accordingly, the exhaust-gas turbocharger ATL has a compressor 1 and a turbine 15 in which a turbine wheel 16 is arranged. The turbine wheel 16 is connected by means of a rotor 17 to a compressor wheel 3 of the compressor 1, which compressor wheel 3 is arranged in a compressor housing 2. In a schematically highly simplified form, a contour ring 5 is depicted in the compressor housing 2 upstream of the compressor wheel 3 as viewed in the flow direction, which contour ring 5 will be explained in detail below on the basis of FIGS. 2 to 4.

The exhaust-gas turbocharger according to FIG. 1 self-evidently also has all the other parts of a conventional exhaust-gas turbocharger, but these are not described here since they are not necessary for explaining the invention.

FIGS. 2 and 3 illustrate a first embodiment of the compressor 1 according to the invention. The compressor 1 has the compressor housing 2 in which the compressor wheel 3 is arranged and which has an inlet region 4 into which the inducted air flows.

A contour ring 5 is arranged in the compressor housing 2, the fastening of which contour ring 5 to the compressor housing 2, which fastening is usually composed of three struts, is not visible on account of the selected sectional illustration.

The contour ring 5 is arranged between the inlet region 4 and the compressor wheel 3, directly upstream of the compressor wheel 3 in the illustrated example, and together with an adjacent wall 7 of the compressor housing 2, delimits a circulation chamber 6. The circulation chamber 6 has a first connecting opening 8 which faces toward the inlet region 4 such that, in the embodiment according to FIGS. 2 and 3, the circulation chamber 6 opens in the direction of the inlet region 4.

Furthermore, a second connecting opening 9 is provided which, as shown in FIG. 2, is arranged adjacent to the compressor wheel 3. Feed flows and return flows into the interior space of the compressor housing 2 are possible through the first and second connecting openings 8, 9.

The compressor 1 according to the invention also has an exhaust-gas recirculation device 11 which is indicated in a schematically highly simplified form in FIGS. 2 and 3. Said exhaust-gas recirculation device 11 has an inlet line 10 arranged in the compressor housing 2. As can be seen in particular from FIG. 2, said inlet line 10 opens out into the circulation chamber 6. As already explained in the introduction, the inlet line 10 may, as illustrated in FIG. 2, open out directly upstream of the first connecting opening 8 in the flow direction, in the region of said first connecting opening 8 or else directly into the circulation chamber 6, which means that, in the illustration selected in FIG. 2, the inlet line 10 could also be arranged offset further to the right, in the direction of the longitudinal axis L, in relation to the illustrated position.

FIG. 2 also shows that the axis A of the inlet line may be inclined at an angle $\alpha$ relative to the longitudinal axis L or to the coordinate direction X of the coordinate system K shown in FIG. 2. The angle $\alpha$ preferably lies in a range of 45±15°.

The view of the compressor 1 in FIG. 3, rotated through 90°, shows a further angle $\beta$ of the axis A with respect to the coordinate direction Z, which angle $\beta$ corresponds to a tangential component for the purpose of swirl generation, and therefore homogenization, in the circumferential direction. Said angle $\beta$ may preferably lie in a range between 15° and 45°. Here, the horizontal direction Z which is shown corresponds to a tangent T to the intake pipe 12 of the compressor housing 2.

The embodiment according to FIG. 4 substantially corresponds to that of FIG. 2, such that the same reference symbols have been used for all corresponding components, and reference may accordingly be made to the above description.

The particularly preferred embodiment of FIG. 4 has, as an additional feature, a ring 13 for noise damping, which ring is arranged between the inlet region 4 and the first connecting opening 8, such that that end-side region of said inlet opening which faces toward the inlet region 4 is covered by the ring 13, as shown in detail in FIG. 4. The inflow into the circulation chamber 6 accordingly takes place through an annular opening 14 which points toward the longitudinal axis L.

In addition to the above written disclosure of the invention, reference is hereby explicitly made to the diagrammatic illustration in FIGS. 1 to 4.

What is claimed is:

1. A compressor (1) of an exhaust-gas turbocharger (ATL) comprising:

a compressor housing (2) having a longitudinal axis (L) in which a compressor wheel (3) is arranged, the compressor housing having an inlet (4), a contour ring (5) which is arranged in the compressor housing (2) between the inlet (4) and the compressor wheel (3), and which, together with an adjacent circumferential wall (7) of the compressor housing (2), delimits a circulation chamber (6) which has a first circulation chamber connecting opening (8) facing toward the inlet (4) and a second circulation chamber connecting opening (9) adjacent to the compressor wheel (3), the first circulation chamber connecting opening (8) and the second circulation chamber connecting opening (9) permitting fluid communication with the circulation chamber, each of the first circulation chamber connecting opening and the second circulation chamber connecting opening being defined by a portion of the contour ring and a portion of the compressor housing, and an exhaust-gas recirculation inlet line (10) defined by the compressor housing (2), an axis (A) being disposed along a length of the exhaust-gas recirculation inlet line (10), the exhaust-gas recirculation inlet line (10) having first and second ends, wherein the second end of the exhaust-gas recirculation inlet line (10) has an opening (18) which opens out into the circulation chamber (6) at the first circulation chamber connecting opening (8), and wherein the axis (A) of the exhaust-gas recirculation inlet line (10) is at a first angle ($\alpha$) that has an inclined non-perpendicular relationship to the longitudinal axis (L) of the compressor housing (2) and a second angle ($\beta$) that has a tangentially inclined, non-perpendicular relationship to the compressor housing (2) that at least partially delimits the circulation chamber (6), the second angle further being relative to a cross-section circumferential direction of the compressor housing (2), and the inclination of the first angle ($\alpha$) along with the tangential inclination of the second angle ($\beta$) of the exhaust-gas recirculation line (10), in combination, cooperate to produce a swirl generation of fluid in the circulation chamber (6) that results from fluid being received from the exhaust-gas recirculation inlet line (10) during operation of the compressor (1) of the exhaust-gas turbocharger (ATL).

2. The compressor as claimed in claim 1, wherein a ring (13) is arranged, spaced apart from and upstream of the first circulation chamber connecting opening (8) relative to a direction of fluid flow from the inlet to the compressor wheel (3), in the compressor housing (2).

* * * * *